United States Patent [19]

Repetto

[11] Patent Number: 4,559,794

[45] Date of Patent: Dec. 24, 1985

[54] AUTOMATIC CYCLE MACHINE FOR THE CONTINUOUS FLESHING OF SKINS

[75] Inventor: Silvio Repetto, Modena, Italy

[73] Assignee: S.p.A. Luigi Rizzi & C., Modena, Italy

[21] Appl. No.: 524,294

[22] Filed: Aug. 18, 1983

[30] Foreign Application Priority Data

Sep. 10, 1982 [IT] Italy ..... 23215 A/82

[51] Int. Cl.[4] ..... C14B 1/06

[52] U.S. Cl. ..... 69/43; 69/44

[58] Field of Search ..... 69/40, 42, 43, 44

[56] References Cited

U.S. PATENT DOCUMENTS

| | | | |
|---|---|---|---|
| 1,462,180 | 7/1923 | Richter | 69/42 |
| 3,552,157 | 1/1971 | Repetto | 69/42 |

FOREIGN PATENT DOCUMENTS

| | | | |
|---|---|---|---|
| 225684 | 9/1910 | Fed. Rep. of Germany | 69/40 |
| 278615 | 10/1914 | Fed. Rep. of Germany | 69/40 |
| 2336951 | 2/1975 | Fed. Rep. of Germany | 69/42 |
| 2536772 | 3/1976 | Fed. Rep. of Germany | 69/42 |

*Primary Examiner*—W. Carter Reynolds

*Attorney, Agent, or Firm*—Karl F. Ross; Herbert Dubno

[57] ABSTRACT

The fleshing machine according to the invention comprises a supporting frame, which bears two parallel blade cylinders, and on which two sliding heads provided with bearing, pressing and drawing rollers are mounted. The heads press the skin between the rollers and draw it under the action first of one and then of the other blade cylinder for the complete fleshing of the skin, in two stages beginning from the middle while keeping the skin pressed during the entire processing cycle.

7 Claims, 9 Drawing Figures

AUTOMATIC CYCLE MACHINE FOR THE CONTINUOUS FLESHING OF SKINS

FIELD OF THE INVENTION

The present invention relates to a machine for the continuous fleshing of skins, which carries out two processing stages from the center towards the head and from the center towards the tail in an automatic manner, keeping the skin pressed during the whole processing period.

BACKGROUND OF THE INVENTION

As is known, the flashing of a skin is carried out when the skin is still fresh after flaying or after its processing in a limiting pit. In either case the skin is, at the time of fleshing, in a very damp condition and bears compact matter and clots of flesh or fat on the inside. The fleshing of a skin requires shaving or cutting off, by means of rotating blades, these clots or projections and this can be only done by passing the skin past a series of blades, knives or the like, which are usually connected to a rotating roller. To this purpose, it is necessary for the skin to be processed from a region central of its length (middle area), because the ends of the skin appendages corresponding to the head, paws and tail from which it is impossible to start the processig. For this reason, approximately one half of the skin is inserted into the fleshing machine, pressed at that point between the drawing rollers and then advanced and subjected to the cutting action of a series of blades of a roller rotating in the opposite direction to the direction of advance of the skin.

In known machines the operator is obliged, at the end of the first processing period, to take the skin out and to insert it again on its opposite side, while in the known continuous machines the operator is obligned, as soon as the machine commences the processing, to turn the half of the skin which is left outside the drawing rollers and to locate it on an upper conveyor belt so as to cause it to advance towards a second fleshing machine.

If it takes into consideration that a normal skin may be two or three meters in length and is relatively heavy, it will be understood that the upward turning over of half the skin, covered with fatty substances and being both slippery and repellent, requires considerable use of manpower and time in order to correctly execute the operation.

Machines for continuous fleshing have also been proposed, which operate with two cylinders with blades (blade cylinders), the transfer from each to the other of them being effected by means of conveyor rollers, on which the skin is left after the first processing to be subsequently grasped by the drawing unit of the second blade cylinder.

Notwithstanding the solutions which have till now been adopted, some problems which make processing difficult nevertheless remain.

In fact, the use of two separate machines or processing units, which are linked by a conveying system with belts, rollers and the like, requires a careful control and presents the risk that small size skins may fall off. Furthermore, it is possible that a complete fleshing of the length middle area of the skin will not be effected, owing to a lack of overlapping of the processing starting positions of the two paired machines. Manual intervention for controlling the processing at any stage is therefore required.

SUMMARY OF THE INVENTION

These and other problems are solved by the present invention, which provides a continuous fleshing machine, which comprises a fixed frame, which supports a pair of blade cylinders rotating in opposite directions, and on which two heads movable by translation each with respect to the other and both with respect to said fixed frame are arranged on guiding tracks, the two heads supporting co-operating members which constitute, when the heads are near to each other, bearing, pressing and drawing means for the skin in two directions, movement means for the reciprocal approaching of the heads and movement means for the translation in couple of the heads with respect to the fixed frame, between two extreme processing positions by the action of one or of the other blade cylinders respectively, and automatic means for controlling each stage of the processing of the skin.

In particular, the bearing, pressing and drawing means of the skin consists of a bearing roller for the skin, which is arranged on one of the heads and of one or more elastic drawing rollers, arranged on the other of the heads, the rollers being power-driven in rotation in both directions. The means for the reciprocal approaching of the heads for their translation in couple are of a mechanical type and are controlled by electric motors or, in the alternative, consist of fluid-dynamic actuators and the like.

On the head supporting the bearing roller a pressing slide having a double working area, which co-operates with the blade cylinders and which is disposed below the bearing roller, is provided. Furthermore, means for sensing the position of the heads are provided and control the slowing down of the motion of the heads themselves and control the starting of the drawing motion of the skin one or in the other direction at a point near the working position in proximity to one or the other of the continuously rotating blade cylinders.

The automatic means for controlling the course of the skin processing can include one or more photocell sensors or the like, preferably arranged on the member supporting the pressing slide, below the bearing roller, the sensors actuating, at the end of the skin being processed on the first blade cylinder, the stop of the drawing motion and the starting of the translation movements in the direction of the second blade cylinder regulatable timing means being furthermore provided for stopping the machine in the open position at the end of the processing cycle of a skin.

In the machine according to the invention, the skin is kept pressed between the drawing rollers and the bearing roller during the whole processing cycle and the mentioned disadvantages of the prior art are so avoided.

BRIEF DESCRIPTION OF THE DRAWING

A more detailed description of the machine, in an embodiment illustrated as an example, refers to the accompanying drawings, in which.

SPECIFIC DESCRIPTION

Figure 1:
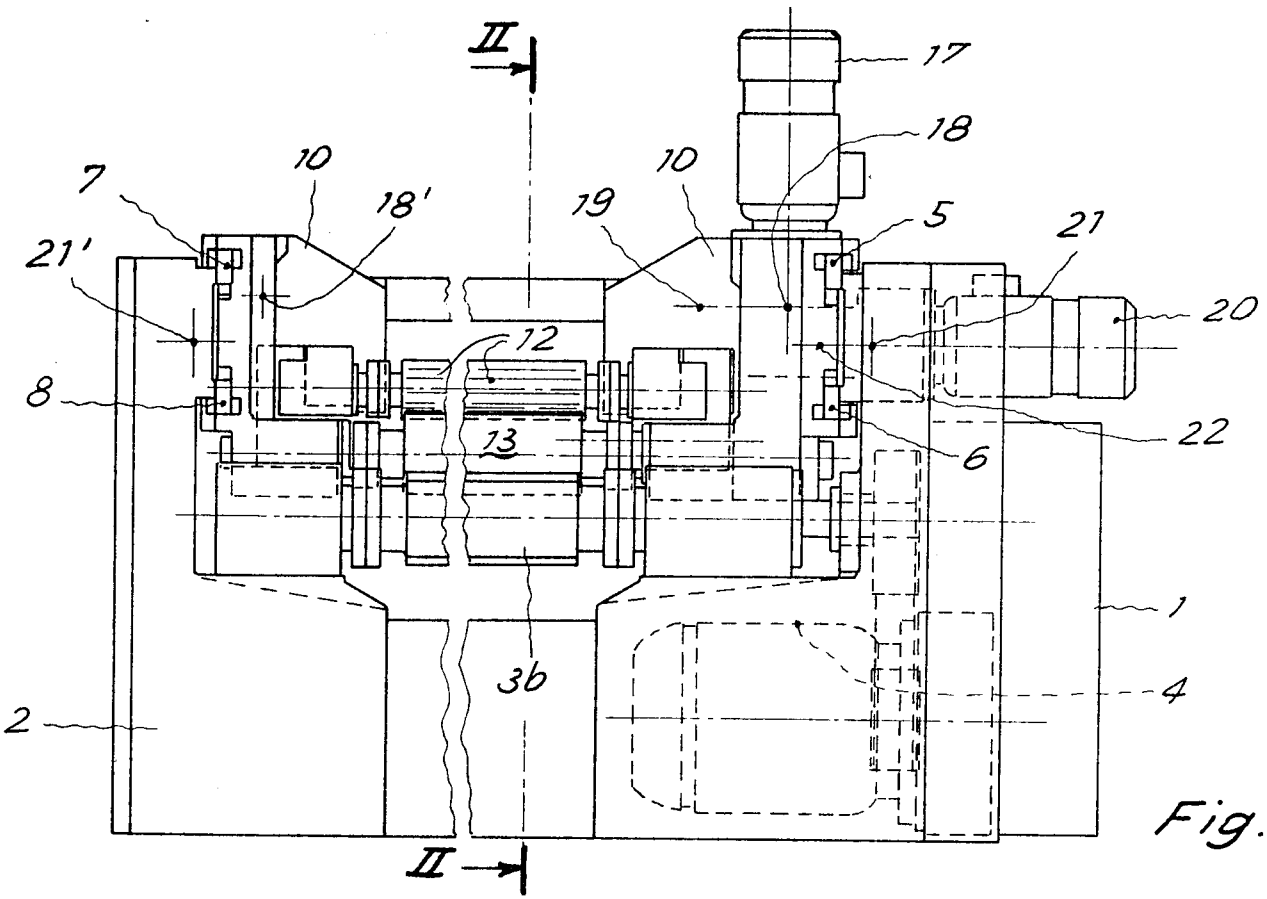
FIG. 1 is a front elevational view of the machine.
Figure 2:
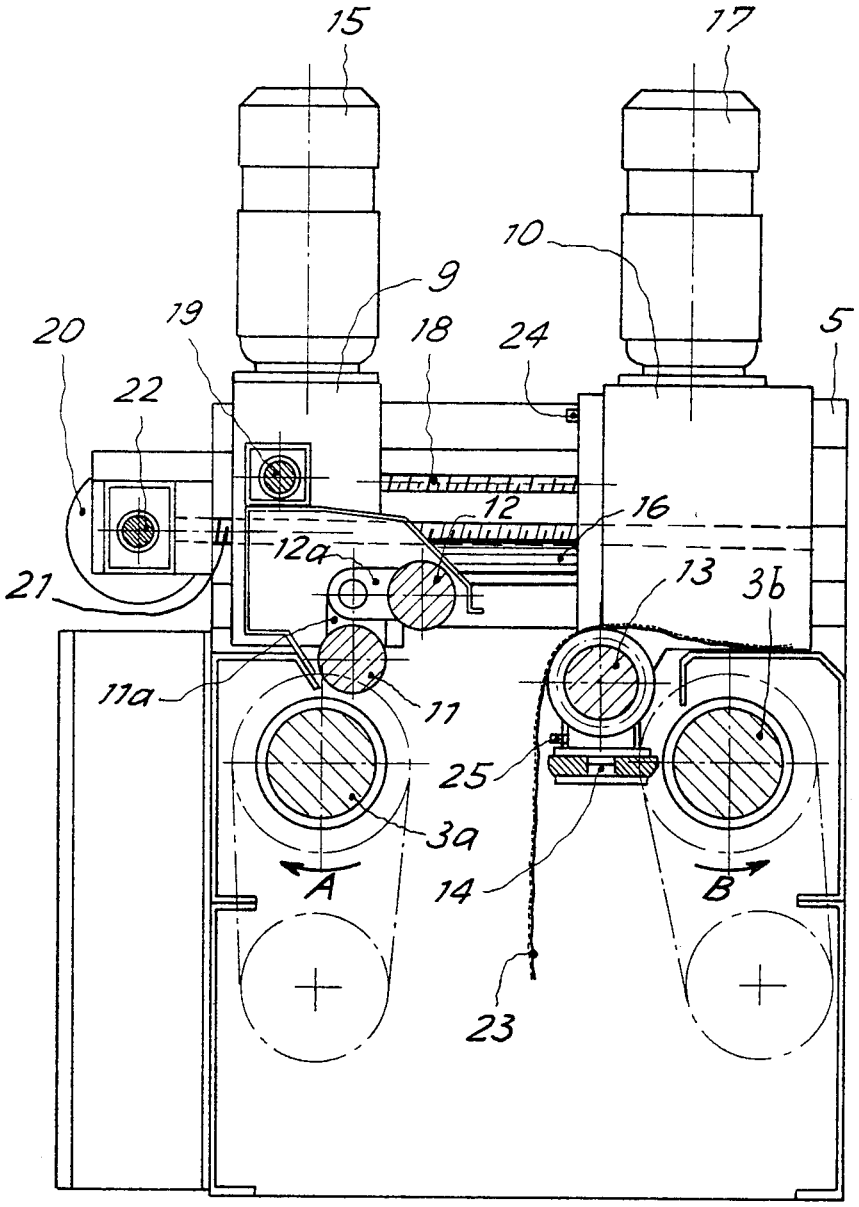
FIG. 2 is a sectional view taken along to line II—II of FIG. 1.
Figure 3:
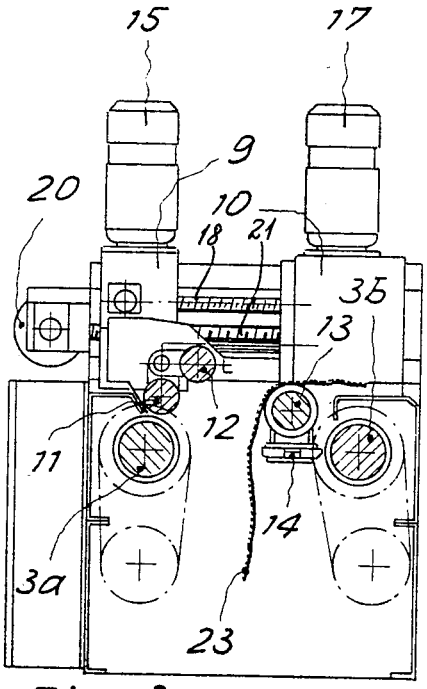
FIGS. 3, 4, 5, 6, 7, 8 and 9 show a succession of stages in the processing of a skin.

The machine for continuous fleshing according to the invention consists of a pair of supporting frame sides 1 and 2 bearing between them two blade cylinders 3*a* and 3*b* rotating according to the arrows A-B respectively, (FIG. 2) which are actuated by a motor 4 with driving gear sets or by a pair of independent motors. On the frame sides 1 and 2 the guides 5, 6, 7 and 8 are disposed, on which the movable heads 9 and 10 can slide. The heads in turn carry the drawing rollers 11 and 12 respectively, which are arranged on elastic lever supporting means 11*a* and 12*a*, pivoted about an axis parallel to the axes of blade cylinders 3*a* and 3*b* and the bearing roller 13, below which is disposed the double pressing slide 14, integral with the head 10, and having elastic bearing members realized according to the prior art, for example as described in the Italian Patent No. 1051951 of the Applicant. The drawing rollers 11 and 12 and the bearing roller 13 are power-driven in both directions of rotation by the motor 15, which controls the rollers by means of gear drive sets or the like coupled to the splined shaft 16 and sliding there on. The two heads 9 and 10 are movable relative to one another by means of the motor 17 actuating the screw 18 and, through the countershaft (only the axis of which is shown in FIG. 1), a corresponding screw 18' on the opposite frame side. The motor 20 is connected to the head 10 by means of the screw 21 and, on the opposite frame side, by means of the corresponding screw 21' only the axis of which is shown in FIG. 1, which is actuated by the shaft 22 and which operates the translation of the head 10 with respect to the blade cylinders 3*a* and 3*b*.

According to the shown diagrammatic configuration, the operating cycle of the machine can be described in accordance with what is shown in FIGS. 3 to 9.

The cycle starts with the machine open and with the drawing rollers 11 and 12 stationary in a position (FIG. 3) in which the skin 23 can be inserted upon the roller 13, with the "flower" side turned against the roller itself and the side to be fleshed (dashed in the Figures) upwardly disposed.

Figure 4:
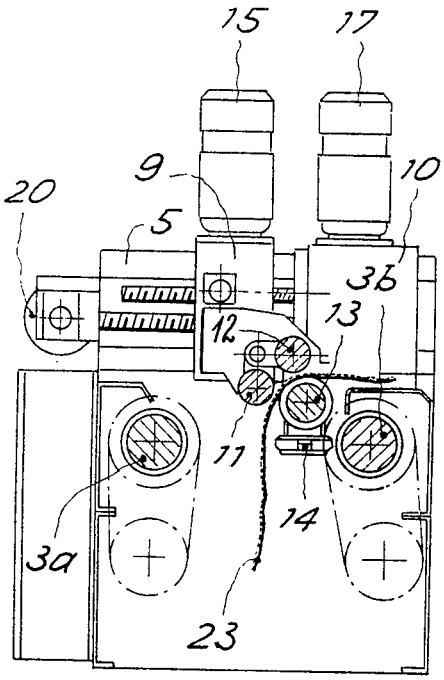

A manual or automatic control then actuates the motor 17, which, by means of the screws 18 and 18' rotating within corresponding internal threads of the head 9, draws the head 9 toward the head 10, so pressing the skin between the bearing roller 13 and the drawing rollers 11 and 12 (FIG. 4). When the machine is closed, the closing being controlled by a limit switch sensor 24 or the like, the motor 20, which moves both heads 9 and 10 accordingly towards the continuously rotating blade cylinder 3*a*, is automatically actuated.

A controlling system is provided, by means of limit switches, photocells and the like, which operates a quick approaching movement to a position near the working position and subsequently a slow movement, actuating at the same time the rollers for the drawing of the skin.

Figure 5:
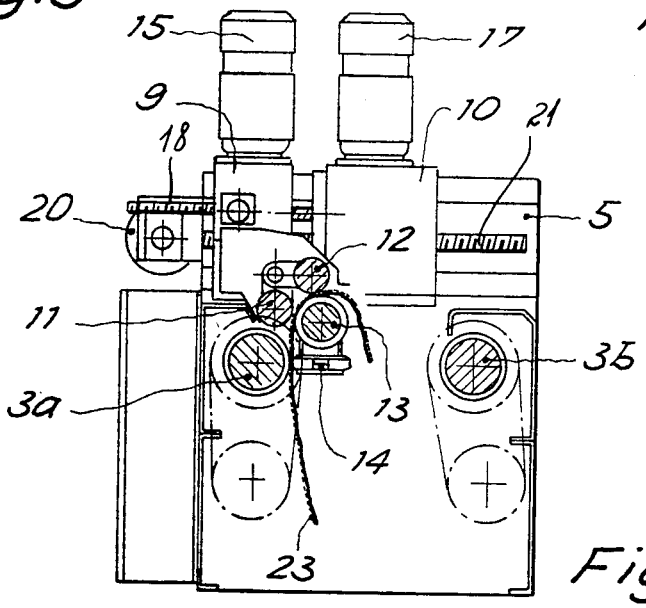
Figure 6:
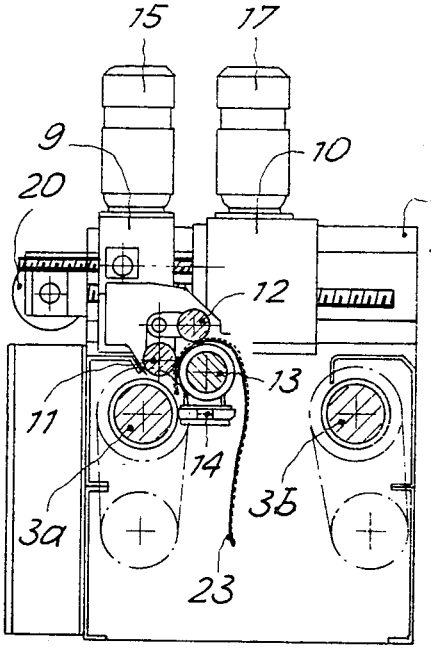
Figure 7:
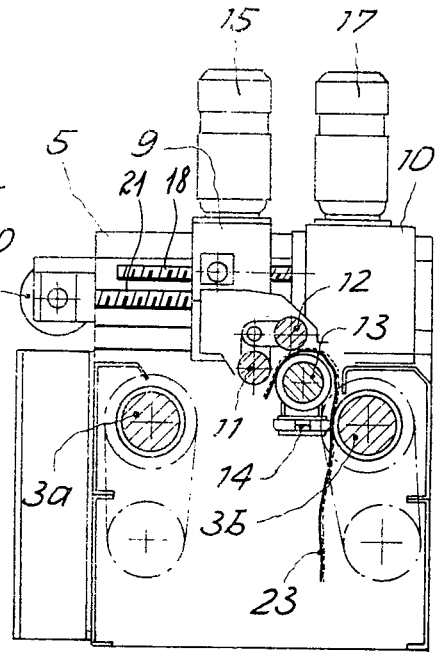
Figure 8:
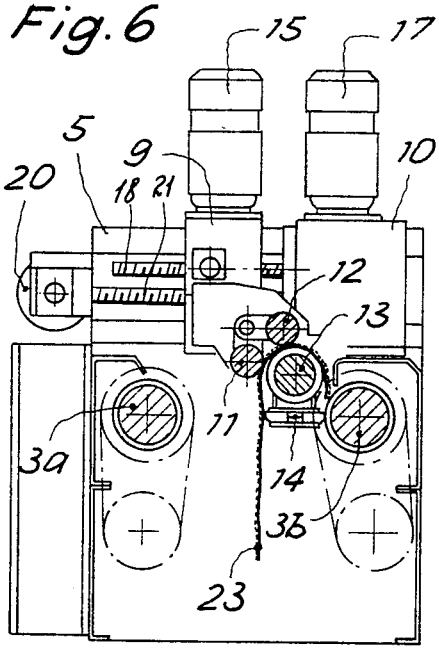
Figure 9:
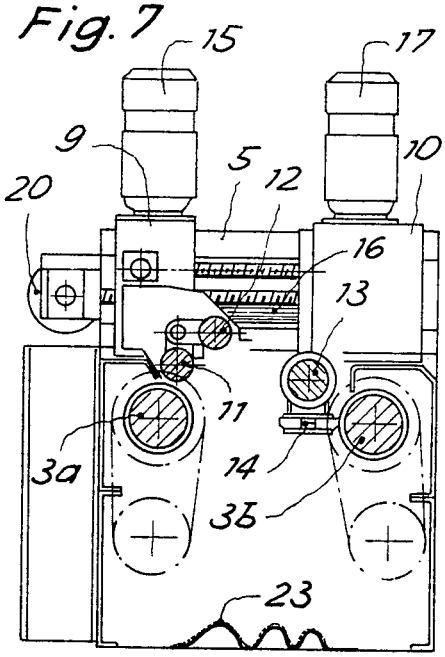

Thus, a gradual starting is achieved so avoiding damages to the skin to be processed (FIG. 5). When the first half of the skin has been fleshed, due to the action of the blade cylinder 3*a* in opposition to the pressing slide 14 (FIG. 6) the sensor 25 for example of the photocell type, actuates the stop of the movement of the rollers 11, 12 and 13. The motor 20 starts in the opposite direction and both heads 9 and 10, keeping the skin pressed between the rollers 11, 12 and 13, move towards the blade cylinder 3*b*. In a manner similar to the above described, the gradual approach to the cylinder 3*b* rotating according to the arrow B takes place, while the rollers 11, 12 and 13 are driven in a direction opposite to the preceding one (FIG. 7), the processing of the skin commencing with a partial overlapping of the starting area to that one previously processed.

At the end of the skin processing (FIGS. 8 and 9), which is signalled by a photocell sensor or by a timer to be regulated in accordance with the type and the size of the skin as well as with the processing speed, or by a similar system, the skin falls to the bottom of the machine, where it can be collected either manually or by means of a belt conveyor or the likee, and the two heads 9 and 10 move away from each other (FIG. 9), preparing for the processing of a subsequent skin.

With the above described operation, the skin is always kept pressed between the rollers 11, 12 and 13 in each stage of the processing and avoids any disadvantage caused by displacements or inaccurancies as to the position of the skin in the course of processing or by the dropping of small size skins.

The translation movements of the heads can be realized in various manners besides with head screws or the like mechanical systems actuated by electric motors as in the described example. Known movement systems can be in fact utilized, of hydraulic or pneumatic type and so forth, according to more convenient choices of the design, in relation to the particular characteristics of each machine and to the required ratings.

As it appears evident to the person skilled in the art, various blade sharpening, controlling, regulating, operator protecting means and so on are present, which are of a known type and which are here omitted for the sake of brevity.

In addition the above mentioned, numerous construction variations can be carried out without however departing from the scope of the present invention in its general characteristics.

I claim:

1. A continuous fleshing machine for processing a skin from a middle area toward each of two opposite ends of the skin, said machine comprising:

a frame;

a pair of blade cylinders journaled on said frame and transversely spaced apart but parallel to one another and rotatable in opposite senses;

guide means on said frame extending transverse to said blade cylinders for defining a path of movement transverse to said cylinders;

a first head shiftable on said guide means along said path and provided with a bearing roller for receiving a skin and means for pressing said skin against said blade cylinders, said bearing roller being disposed between said blade cylinders;

a second head provided with a pair of drawing rollers and shiftable on said guide means along said path, said drawing rollers being positioned to cooperate with said bearing roller and hold said skin thereon in a position of said heads wherein said heads are proximal to one another;

respective drives on said heads for driving said bearing roller and said drawing rollers;

first movement means for relatively displacing said heads for bringing together said drawing rollers and said bearing roller and for shifting said drawing rollers and said bearing roller apart; and second movement means for displacing said heads jointly along said guide means.

2. The machine defined in claim 1 wherein said first movement means includes a lead screw interconnecting said heads and an electric motor for driving said lead screw.

3. The machine defined in claim 1 wherein said second movement means includes a lead screw connected to said first head and an electric motor connected to said lead screw.

4. The machine defined in claim 1 wherein said drawing rollers are mounted upon arms pivoted about an axis parallel to the axes of said blade cylinders.

5. The machine defined in claim 1 wherein said means for pressing said skin is a pressing slide and said first head is provided below said bearing roller with said pressing slide having working areas on opposite sides thereof for pressing said skin against each of said blade cylinders.

6. The machine defined in claim 1, further comprising sensor means responsive to the positions of said heads and adapted to control the movement thereof.

7. The machine defined in claim 1 wherein said drawing rollers and said bearing roller are constructed and arranged to maintain said skin pressed between them during an entire processing cycle.

* * * * *